US009692150B2

(12) United States Patent
Edmonds et al.

(10) Patent No.: US 9,692,150 B2
(45) **Date of Patent: *Jun. 27, 2017**

(54) TOOL-LESS COAXIAL CABLE CONNECTOR

(71) Applicant: PCT International, Inc., Mesa, AZ (US)

(72) Inventors: Samuel S. Edmonds, Gilbert, AZ (US); Timothy L. Youtsey, Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/378,467

(22) Filed: Dec. 14, 2016

(65) Prior Publication Data

US 2017/0093054 A1 Mar. 30, 2017

Related U.S. Application Data

(63) Continuation of application No. 14/847,893, filed on Sep. 8, 2015, now Pat. No. 9,553,375.

(Continued)

(51) Int. Cl.
*H01R 9/05* (2006.01)
*H01R 13/502* (2006.01)

(Continued)

(52) U.S. Cl.
CPC ..... *H01R 9/0521* (2013.01); *H01R 13/502* (2013.01); *H01R 24/38* (2013.01); *H01R 2103/00* (2013.01)

(58) Field of Classification Search
CPC .... H01R 9/0521; H01R 13/502; H01R 24/38; H01R 2103/00; H01R 9/05; H01R 9/0518; H01R 9/0524; H01R 13/59; H01R 4/50

(Continued)

(56) References Cited

U.S. PATENT DOCUMENTS 3,199,061 A * 8/1965 Johnson ..... H01P 1/045 174/75 C
5,137,470 A * 8/1992 Doles ..... H01R 24/564 439/578

(Continued)

FOREIGN PATENT DOCUMENTS

EP 1935061 B1 * 7/2015 ..... H01R 9/0524
WO WO 2007037901 A2 * 4/2007 ..... H01R 9/0524

(Continued)

*Primary Examiner* — Tulsidas C Patel
*Assistant Examiner* — Travis Chambers
(74) *Attorney, Agent, or Firm* — Thomas W. Galvani, P.C.; Thomas W. Galvani

(57) ABSTRACT

A coaxial cable connector includes a cylindrical body having a longitudinal axis, a front end, an opposed rear end, an interior, and an inner surface bounding the interior. A cylindrical inner post extends through the cylindrical body, supports the cylindrical body, and has an outer surface. A coupling nut is carried on the inner post at the front end of the cylindrical body. A first thread is formed on the inner surface of the body and has a ramped entrance directed toward the rear end of the body and a blunt end directed toward the front end of the body. A second thread is formed on the outer surface of the inner post and has a ramped entrance directed toward the rear end of the body, a blunt end directed toward the front end of the body, and a plurality of stops therebetween.

20 Claims, 11 Drawing Sheets

Related U.S. Application Data

(60) Provisional application No. 62/047,520, filed on Sep. 8, 2014.

(51) Int. Cl.
*H01R 24/38* (2011.01)
*H01R 103/00* (2006.01)

(58) Field of Classification Search
USPC ..... 439/583, 578, 584; 174/89
See application file for complete search history.

(56) References Cited

U.S. PATENT DOCUMENTS 5,393,244 A * 2/1995 Szegda ..... H01R 24/40 439/394
7,144,272 B1 * 12/2006 Burris ..... H01R 9/05 439/578
7,753,727 B1 * 7/2010 Islam ..... H01R 9/0521 439/583
8,753,147 B2 * 6/2014 Montena ..... H01R 9/05 439/502
9,004,931 B2 * 4/2015 Montena ..... H01R 9/0524 439/253
9,553,375 B2 * 1/2017 Edmonds ..... H01R 9/0521
2014/0342594 A1 * 11/2014 Montena ..... H01R 9/0524 439/359
2015/0050825 A1 * 2/2015 Krenceski ..... H01R 9/0524 439/277
2015/0118901 A1 * 4/2015 Burris ..... H01R 24/38 439/584
2015/0180141 A1 * 6/2015 Wei ..... H01R 13/622 439/583

FOREIGN PATENT DOCUMENTS

WO WO 2007055871 A1 * 5/2007 ..... H01R 9/05
WO WO 2008042763 A2 * 4/2008 ..... H01R 9/0503
WO WO 2008042763 A3 * 6/2008 ..... H01R 9/0503

* cited by examiner

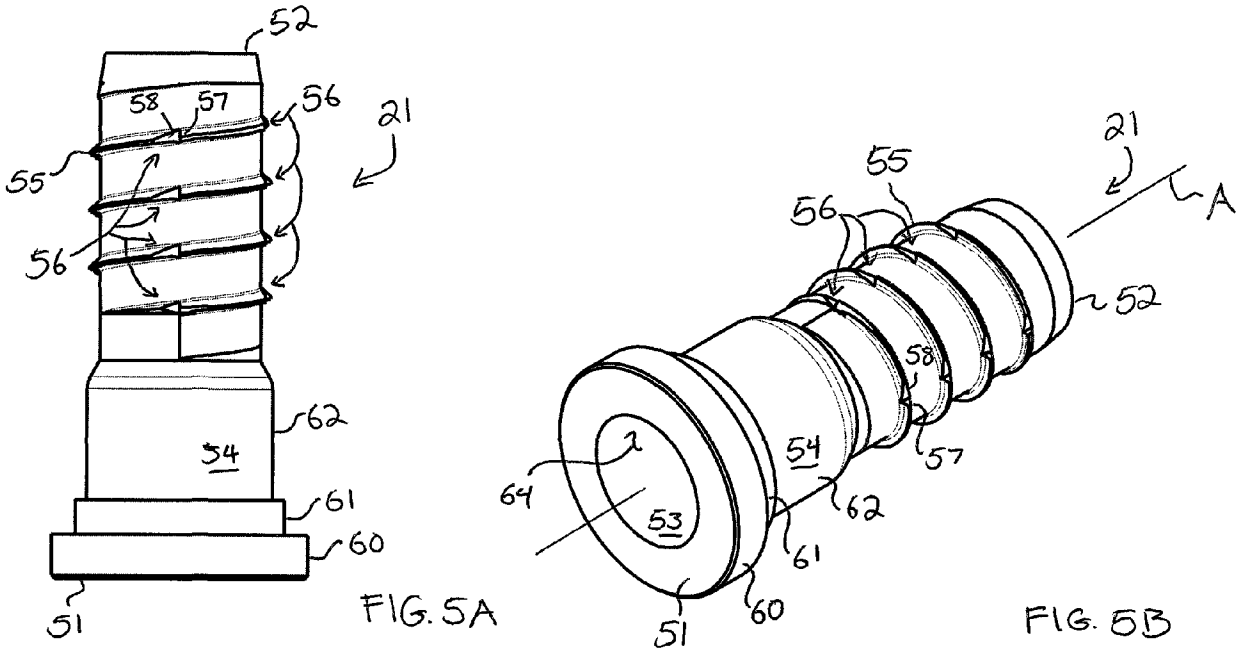
FIG. 5A
FIG. 5B
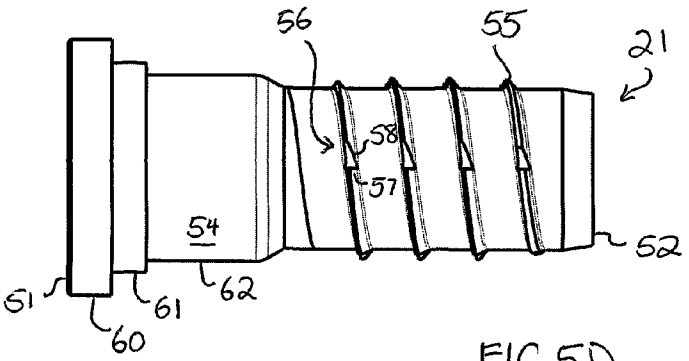
FIG. 5D
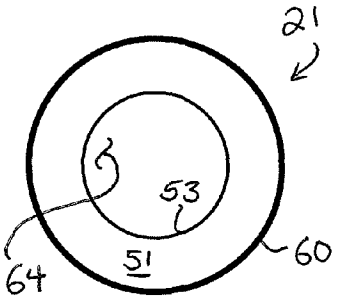
FIG. 5C

TOOL-LESS COAXIAL CABLE CONNECTOR

CROSS-REFERENCE TO RELATED APPLICATIONS

This application is a continuation of and claims the benefit of U.S. patent application Ser. No. 14/847,893, filed Sep. 8, 2015, now U.S. Pat. No. 9,553,375, which claimed the benefit of U.S. Provisional Application No. 62/047,520, filed Sep. 8, 2014, all of which are hereby incorporated by reference.

FIELD OF THE INVENTION

The present invention relates generally to electrical apparatuses, and more particularly to coaxial cable connectors.

BACKGROUND OF THE INVENTION

Coaxial cables transmit radio frequency ("RF") signals between transmitters and receivers and are used to interconnect televisions, cable boxes, DVD players, satellite receivers, modems, and other electrical devices and electronic components (hereinafter, "electronic components"). Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be fit with cable connectors to be coupled to electronic components. Connectors typically have a connector body, a nut or threaded fitting mounted for rotation on an end of the connector body, a bore extending into the connector body from an opposed end to receive the coaxial cable, and an inner post within the bore coupled in electrical communication with the fitting. Generally, connectors are crimped onto a prepared end of a coaxial cable to secure the connector to the coaxial cable. However, crimping occasionally results in a crushed coaxial cable which delivers a signal degraded by leakage, interference, or poor grounding. Furthermore, while some connectors are so tightly mounted to the connector body that threading the connector onto the post of an electronic component can be incredibly difficult, other connectors have fittings that are mounted so loosely on the connector body that the electrical connection between the fitting and the inner post can be disrupted when the fitting moves off of the post. Still further, some connectors, if applied too loosely to the cable, will come out of the connector, completely severing the RF connection between the transmitter and the electrical device. Yet still further, connectors typically must be installed with a specialty tool onto a cable, and without that specialty tool, a good quality connection is very difficult to achieve between the cable and the connector. An improved connector for coaxial cables is needed which allows the connector to be installed onto a cable quickly, securely, and without specialty tools.

SUMMARY OF THE INVENTION

A coaxial cable connector includes a cylindrical body having a longitudinal axis, a front end, an opposed rear end, an interior, and an inner surface bounding the interior. A cylindrical inner post extends through the cylindrical body, supports the cylindrical body, and has an outer surface. A coupling nut is carried on the inner post at the front end of the cylindrical body. A first thread is formed on the inner surface of the body and has a ramped entrance directed toward the rear end of the body and a blunt end directed toward the front end of the body. A second thread is formed on the outer surface of the inner post and has a ramped entrance directed toward the rear end of the body, a blunt end directed toward the front end of the body, and a plurality of stops therebetween.

The above provides the reader with a very brief summary of the detailed description presented below, and is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings:

FIGS. 5A, 5B, 5C, and 5D are top plan, top perspective, front elevation, and side elevation views, respectively, of an inner post of the connector of FIG. 1;

DETAILED DESCRIPTION

Figure 1:
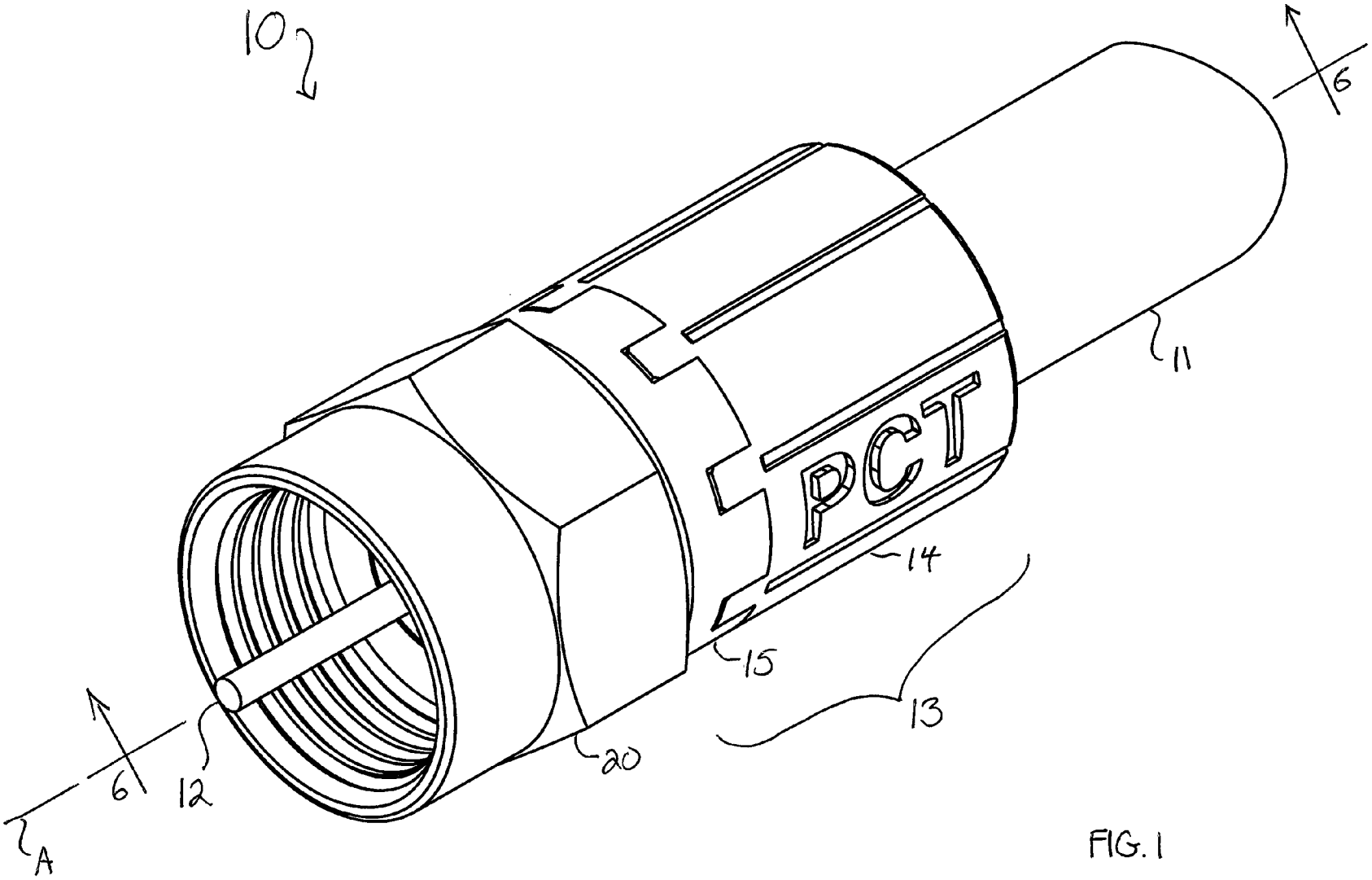
FIGS. 1, 2A, and 2B are perspective, front elevation, and side elevation views, respectively, of a tool-less coaxial cable connector.
Figure 2B:
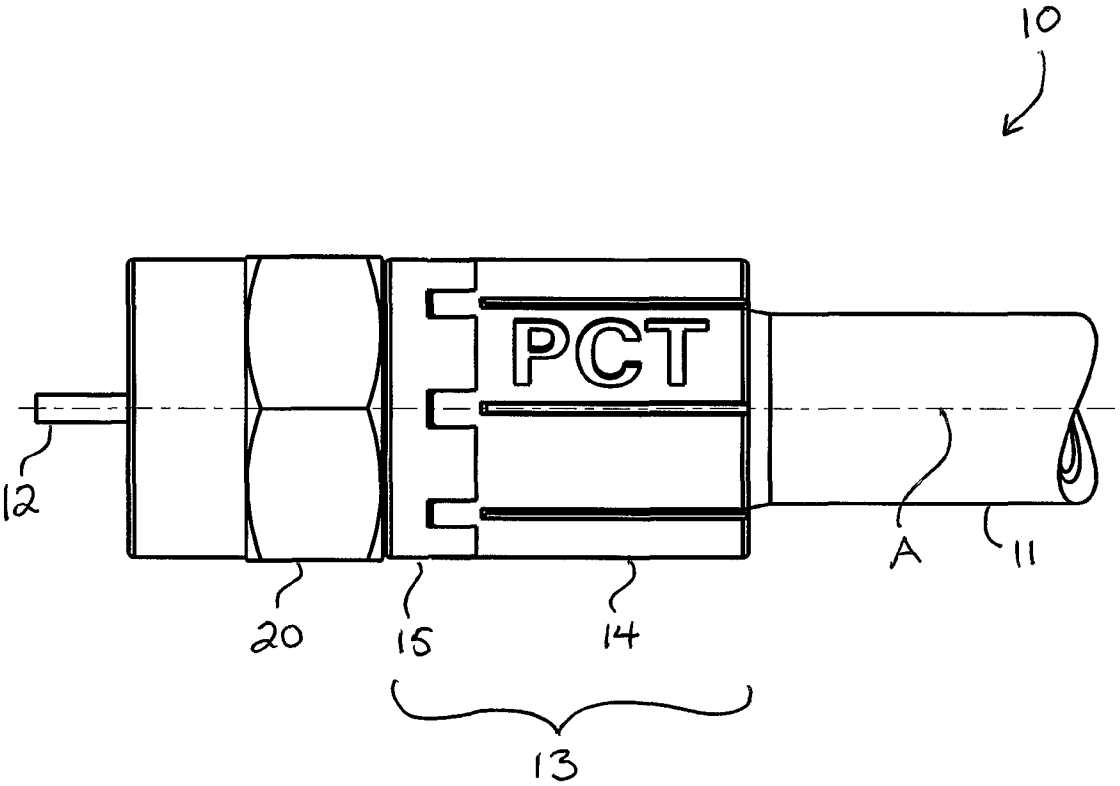
Figure 2A:
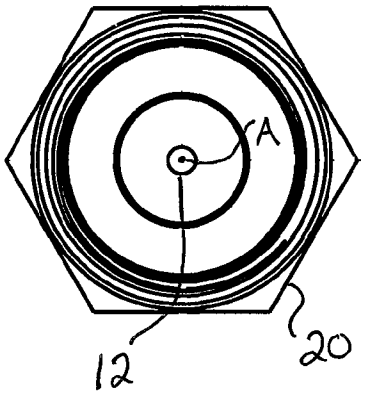

Reference now is made to the drawings, in which the same reference characters are used throughout the different figures to designate the same elements. FIG. 1 illustrates a tool-less coaxial cable connector 10 constructed and arranged in accordance with the principle of the invention, as it would appear in an applied condition on a coaxial cable 11. The embodiment of the connector 10 shown is an F connector for use with an RG6 coaxial cable for purposes of exemplification, but it should be understood that the description below is also applicable to other types of coaxial cable connectors other types of cables. The cable 11 shown is exemplary of a convention coaxial cable, such as an RG6 coaxial cable, and includes an inner conductor 12, shown in FIG. 1 extending out of the connector 10. In the embodiment shown in FIGS. 1-6B, the connector 10 includes a two-piece cylindrical body assembly 13 consisting of a body 14 and a front cap 15. The connector 10 also includes a coaxial coupling threaded fitting or nut 20 mounted for rotation to the cap 15 of the body assembly 13. The cap 15 and the nut 20 are both carried on an inner post 21 shown in FIG. 3. A longitudinal axis A extends through the center of the connector 10, and the body assembly 13, the nut 20, and the inner post 21 each have rotational symmetry with respect to the longitudinal axis A, as shown in FIGS. 2A and 2B.

Figure 3:
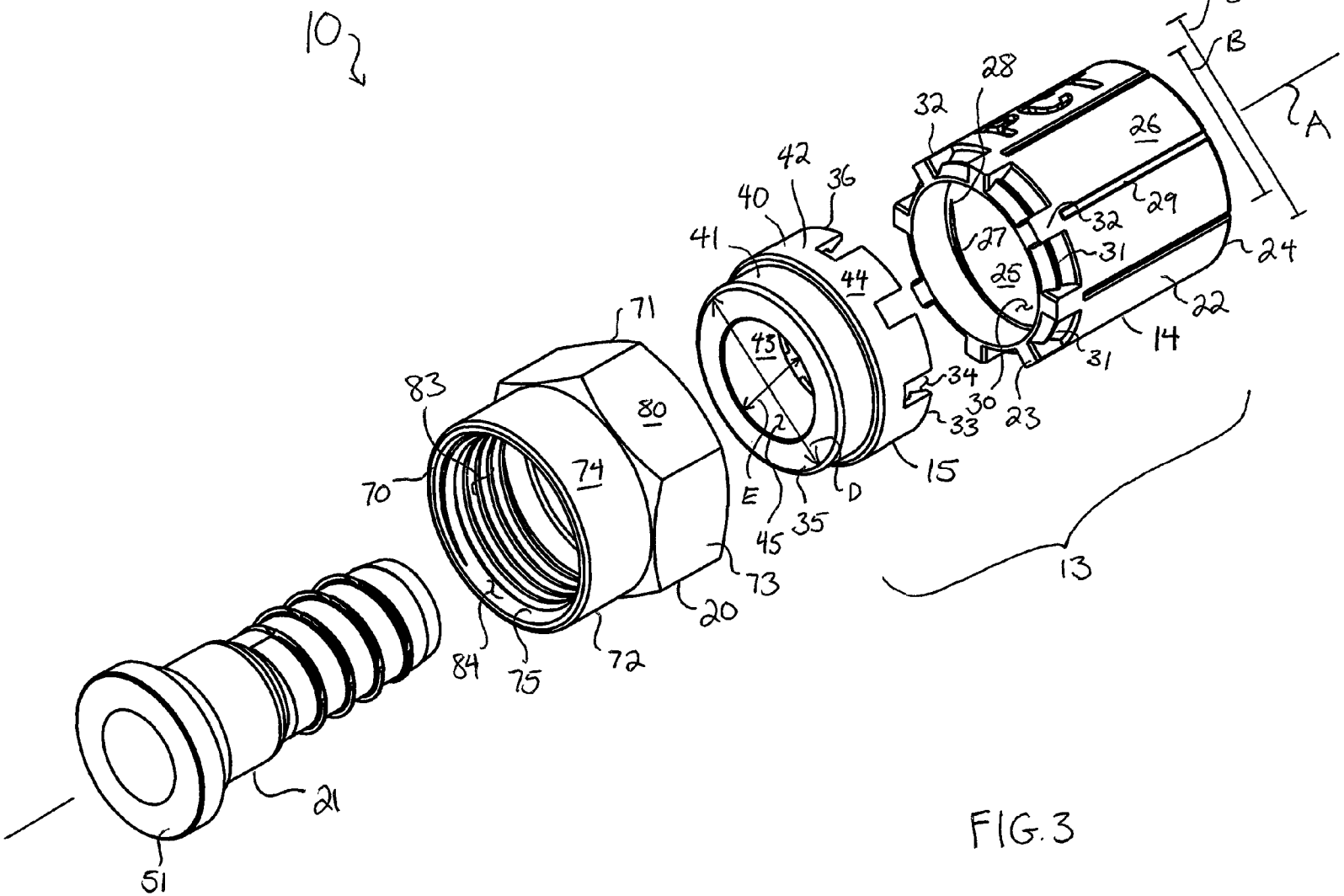
FIGS. 3 and 4 are top and bottom exploded perspective views, respectively, of the connector of FIG. 1.
Figure 6A:
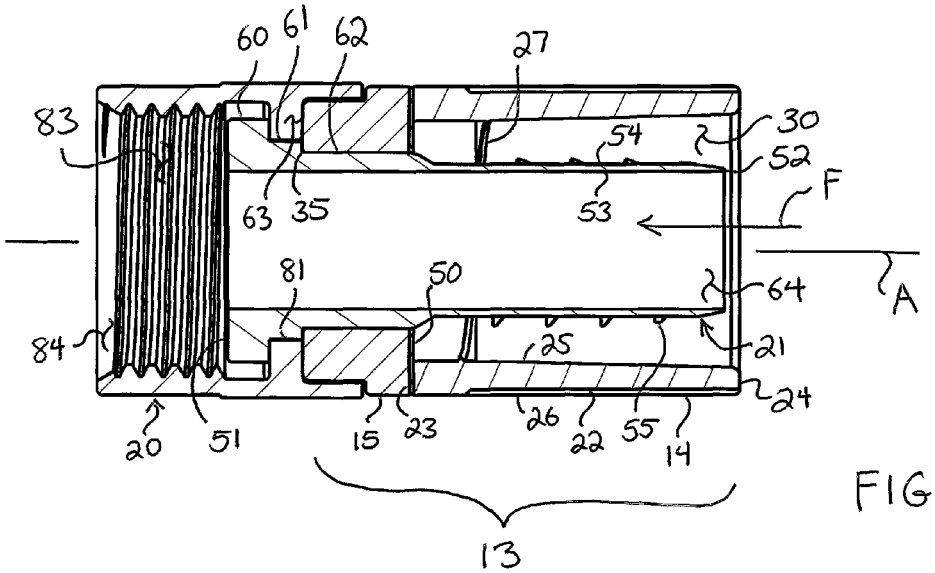
FIGS. 6A and 6B are section views taken along the line 6-6 in FIG. 1 illustrating the connector of FIG. 1 in a free condition and in an applied condition on a cable, respectively.

Turning to FIG. 3 and to FIG. 6A, which is a section view of the connector 10 taken along the line 6-6 in FIG. 1, the body 14 of the body assembly 13 is an elongate, cylindrical sleeve extending along the axis A. The body 14 has a sidewall 22 with opposed front and rear ends 23 and 24 and opposed inner and outer surfaces 25 and 26. The inner surface 25 defines and bounds a cable-receiving interior 30 shaped and sized to receive the coaxial cable 11. The inner surface 25 is formed with a three-quarters helical thread 27 proximate to the front end 23, which begins with a ramp 28 up from the smooth inner surface 25 and terminates approximately three-quarters circumferentially and helically around the inner surface 25 with a vertical stop. The thread 27 thus extends around an incomplete circumferential portion of the body 14. The cable-receiving interior 30 has an inner diameter B defined by the inner surface 25. Both the front and rear ends 23 and 24 are open, providing access to the cable-receiving interior 30. The outer surface 26 of the sidewall 22 is formed with axially-oriented channels or grooves 29 to provide enhanced grip to the body 14. The outer surface 26 defines an outer diameter C of the body 14.

Figure 4:
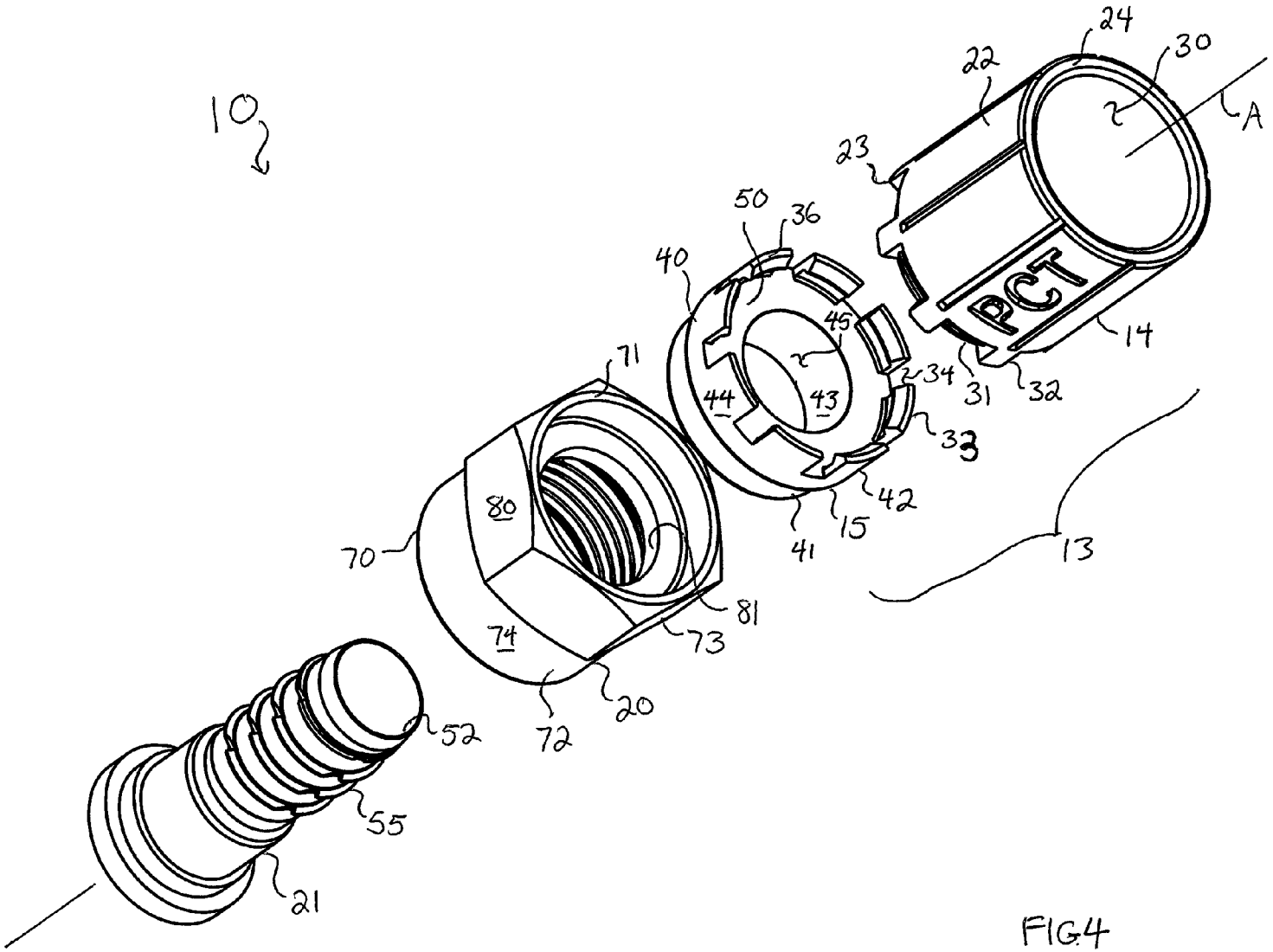

Referring now primarily to FIGS. 3 and 4, the front end 23 of the body 14 has an engagement structure for coupling with the cap 15. The body 14 and cap 15 may be shipped in a separated, loose arrangement for application to the coaxial cable 11 by the technician on site. The cap 15 thus carries engagement structure complemental to that on the body 14 so that the cap 15 may be quickly applied to and assembled on the body 14 on site. The engagement structure on the body 14 is a plurality of semi-annular barbs 31 spaced apart from each other by blocks 32. The complemental engagement structure on the cap 15 is a plurality of rearwardly-extending tabs 33 each with an enlarged head to fit over and engage with the barbs 31. The tabs 33 are spaced apart from each other by gaps 34 sized to receive the blocks 32. The tabs 33 are flexible and capable of deforming radially outward slightly away from the axis A so as to fit over and engage with the barbs 31 when the cap 15 is pressed onto the body 14. The tabs 33 engaged with the barbs 31 prevent axial separation of the cap 15 from the body 14, and the blocks 32 fit within the gaps 34 prevent relative rotational movement of the body 14 and cap 15. In this way, once the tabs 33 are engaged to the barbs 31, the body assembly 13 becomes a unitary piece which will not accidentally disengage.

Still referring to FIGS. 3 and 4, the cap 15 is generally cylindrical and has a front end 35, an opposed rear end 36, and a stepped sidewall 40 extending therebetween. The sidewall 40 has a front portion 41, proximate to the front end 35, and a rear portion 42, proximate to the rear end 36. The rear portion 42 has a diameter equal to the diameter C of the body 14, and the front portion 41 has a diameter D less than the diameter C but greater than the diameter B of the cable-receiving interior 30. The sidewall 40 has an inner surface 43 and an opposed outer surface 44, and the inner surface 43 defines a bore 45 with a diameter E smaller than the diameter of the cable-receiving interior 30 with diameter B. An annular rear face 50 is formed at the rear end 36 between the inner and outer surfaces 43 and 44. This rear face 50 defines a forward stop to the interior 30 when the cap 15 is fitted onto the body 14, as seen in the section view of FIG. 6A.

Returning to FIGS. 3 and 4, the rear end 36 of the cap 15 is marked by the spaced-apart tabs 33 and gaps 34. The enlarged heads of the tabs (most easily seen in FIG. 4), are oriented radially inwardly into the bore 45 and provide an inward clamping engagement force on the barbs 31 on the front end 23 of the body 14 when the cap 15 is engaged to the body 14.

The inner post 21 carries the body assembly 13. The inner post 21 is shown in detail in FIGS. 5A-5D. The inner post 21 is a hollow, elongate, cylindrical sleeve extending along the axis A and having rotational symmetry with respect to that axis A. The inner post 21 has opposed front and rear ends 51 and 52 and opposed inner and outer surfaces 53 and 54. The outer surface 54, proximate to the rear end 52 of the inner post 21, is formed with a helical thread 55 which winds about the outer surface 54 from the rear end 52 to a generally intermediate location between the front and rear ends 51 and 52. The thread 55 is sharp, having a sharp crest between two oblique faces, and forms approximately four helical windings about the inner post 21. By "helical," it is meant that the thread 55 advances both axially and circumferentially. The crest projects radially outwardly from the inner post 21. The thread 55 is both radially and axially offset from the thread 27; while the thread 27 is proximate to the front end 23 of the body 14, the thread 55 is between the thread 27 and the rear end 24 of the body 14.

The thread 55 is formed with a plurality of stops 56. Each stop 56 is a notch in the thread 55 which allows forward movement of the shield 90 of the cable 11 over the thread 55 but limits rearward, or reversed, movement of the shield 90 of the cable 11 over the thread 55. Thus, a cable 11 can be advanced over the inner post 21 in threading engagement but cannot be retracted from the inner post 21. The stops 56 are formed at every quarter-turn around the thread 55 and are thereby aligned axially in quadrants around the inner post 21. Each stop 56 is defined by a blunt edge 57, formed toward the rear end 52 of the inner post 21, and a ramped edge 58, formed toward the front end 51 of the inner post. The blunt edge 57 is a steep discontinuity in the thread 55, at which the thread 55 ends with a face oriented radially with respect to the longitudinal axis A, extending from the crest to the root of the thread 55 at the outer surface 54 of the inner post 21. The ramped edge 58 is a gentle transition from the root of the thread 55 up to the crest of the thread 55 such that a thin or braided conductive metal shield will pass over the ramped edge 58 and back onto the thread 55 under force that can be exerted by hand. The blunt edge 57, in contrast, is steep such that the shield will not pass back and rearwardly over the blunt edge 57, thus preventing the shield from being retracted from the thread 55.

Proximate to the front end 51 of the inner post 21, three annular flanges provide the inner post 21 with a stepped body. Each flange has a similar structure and projects radially away from the axis A. A first flange 60, is formed at the front end 51 of the inner post 21. A second flange 61, having a smaller diameter than the first flange 60, is formed to the rear of the first flange 60. A third flange 62, having a smaller diameter than the second flange 61, is formed to the rear of the second flange 61. Referring to FIG. 6A, the cap 15 is mounted to the inner post 21 at the third flange 62. When the cap 15 is applied to the inner post 21, the front end 35 of the cap 15 cooperates with the flange 60 of the inner post 21 to form an annular channel 63 in which the nut 20 is received. The annular channel 63 limits the axial movement of the nut 20 on the inner post 21.

The inner post 21 is constructed of a conductive material and maintains a continuous RF connection between the nut 20 and the coaxial cable 11. The inner surface 53 of the inner post 21 bounds and defines a cylindrical bore 64 which is sized to tightly receive the coaxial cable 11.

The nut 20 is mounted to the inner post 21 at the annular channel 63 formed between the nut 20 and the cap 15. Referring to FIGS. 3 and 4, the nut 20 is mounted for rotation about the axis A, so that the fitting 20 can be rotated onto a female coaxial post. The nut 20 is a cylindrical sleeve having opposed front and rear ends 70 and 71, a monolithically and integrally-formed ring portion 72 proximate to the front end 70, and an integrally-formed nut portion 73 proximate to the rear end 71. The ring portion 72 has a smooth annular outer surface 74 and an opposed threaded inner surface 75 for engagement with a female coaxial post. The nut portion 73 of the fitting 70 has a hexagonal outer surface 80 to receive the jaws of a tool. The inner side of the nut portion 73 has an annular, inwardly-extending ridge 81 which is seated into the annular channel 63 for rotatable movement therein. With the ridge 81 seated in the annular channel 63, the fitting 20 is prevented from both forward and rearward axial translation. The rear end 71 of the fitting 20 is an annular cuff extending rearwardly from the ridge 81, entirely overlying and concealing the front portion 41 of the cap 15.

A cylindrical interior space 83 extends into the fitting 20 from a mouth 84 formed at the front end 70 of the fitting 20. When the nut 20 is mounted to the inner post 21, the front end 51 of the inner post 21 defines a stop in the interior space 83 beyond which the fitting 20 cannot be applied onto a female coaxial post.

Figure 6B:
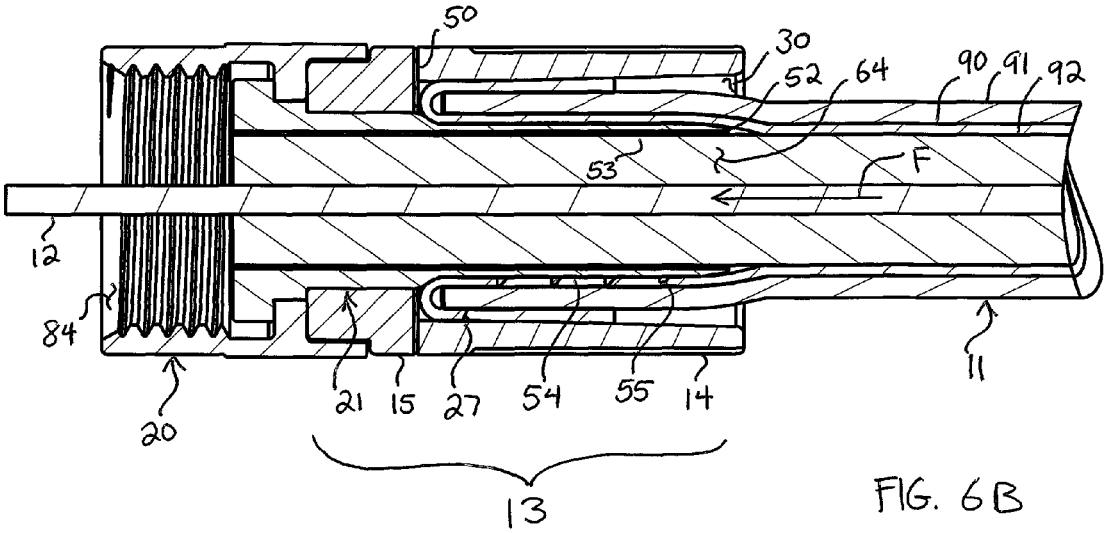
Figure 7:
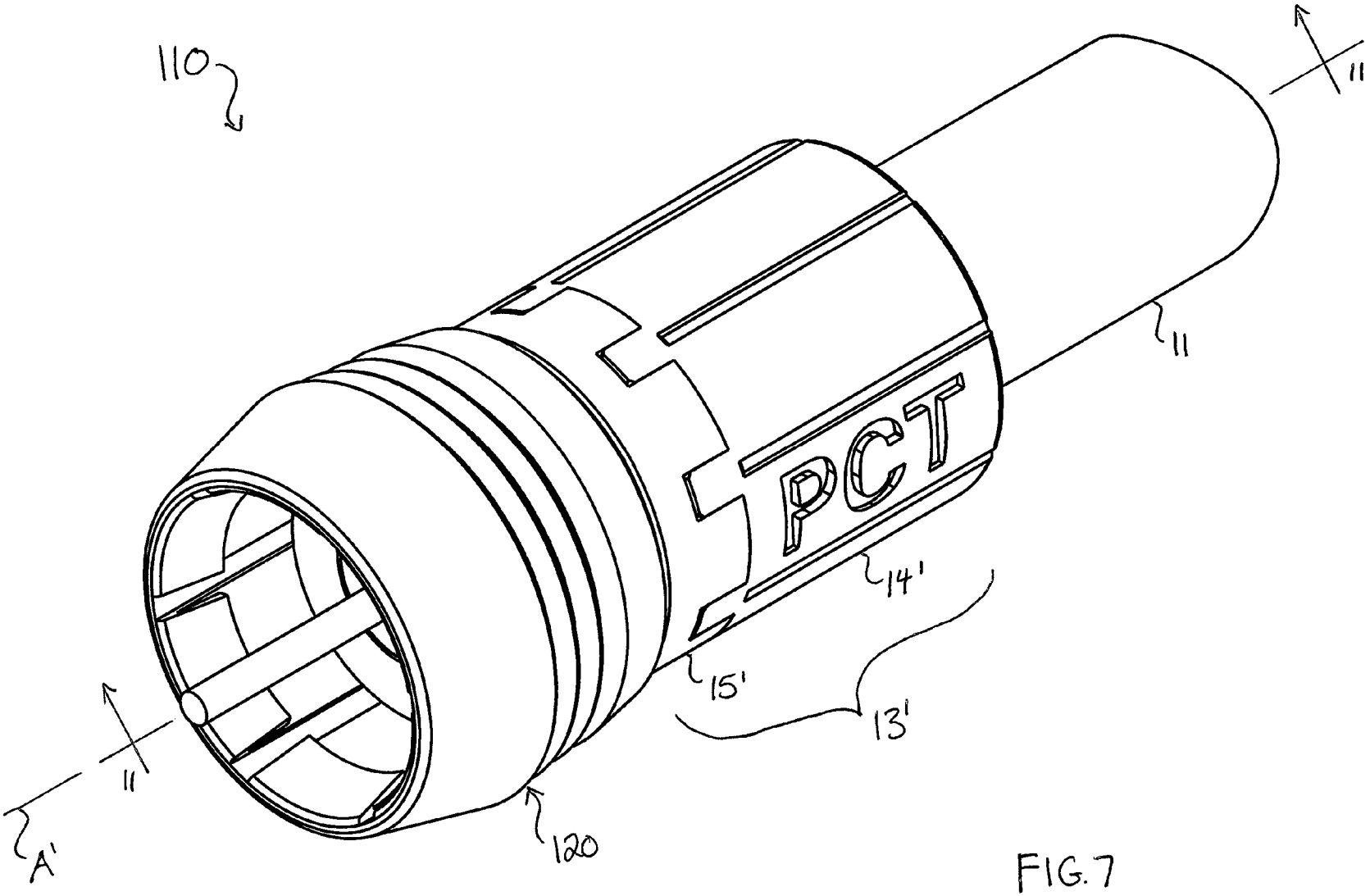
FIGS. 7, 8A, and 8B are perspective, front elevation, and side elevation views, respectively, of a tool-less coaxial cable connector.
Figure 8B:
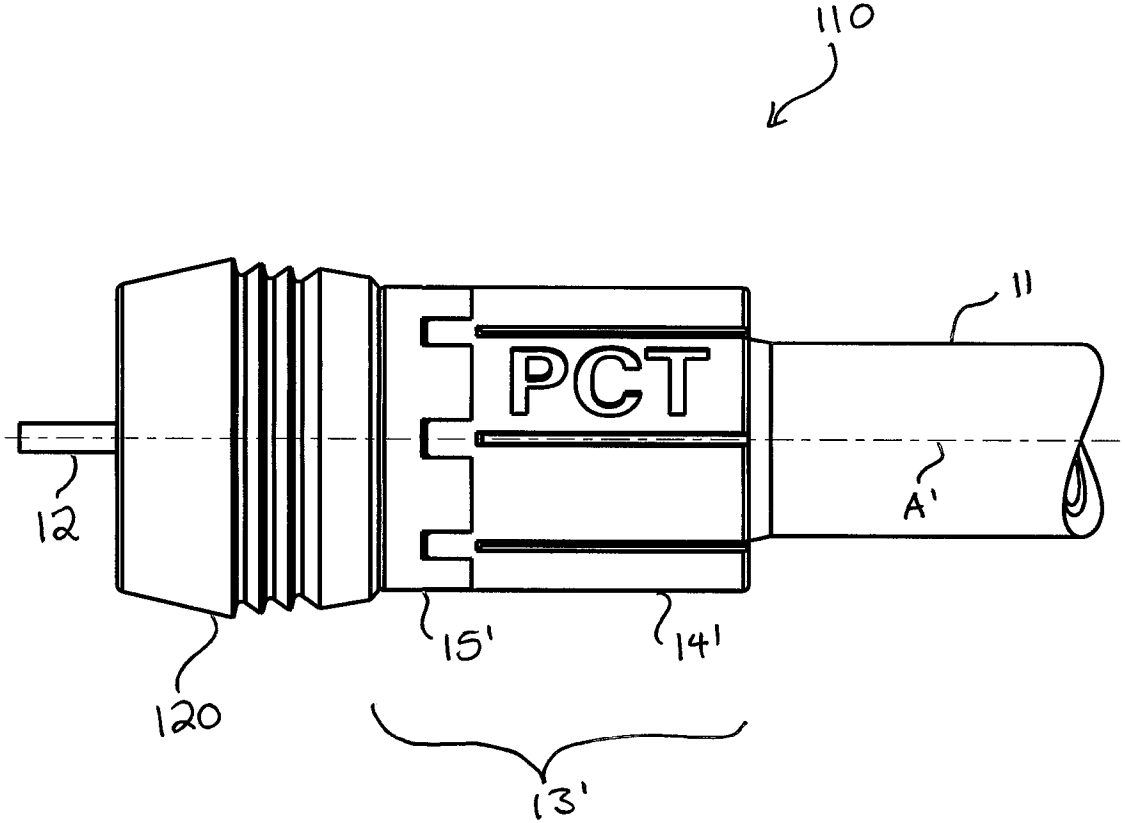
Figure 8A:
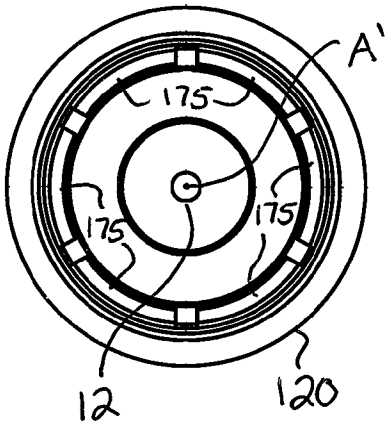

Referring now to FIGS. 6A and 6B, operation of the connector 10 will now be explained. The connector 10 is useful for applying to a coaxial cable 11 without the use of specialty tools, and has structural features and elements which allow the connector 10 to be so applied. Further, the connector 10 resists being accidentally removed from the cable 11. To apply the connector 10 onto the coaxial cable 11, the cable 11 is aligned with the axis A and passed into the cable-receiving interior 30 of body assembly 13 of the connector 10, at the rear end 24 of the body 14, by advancing the cable 11 along a direction indicated by the arrowed line F. The coaxial cable 11 is passed into the cable-receiving interior 30 bound by the body 15 of the body assembly 13. The cable 11 almost immediately encounters the rear end 52 of the inner post 21. Upon encountering the rear end 52 of the inner post 21, the shield 90 and jacket 91 of the cable 11 are advanced over the rear end 52, while the inner conductor 12 and the dielectric insulator 92 are moved into the bore 64 within the inner surface 53 of the inner post 21. The connector 10 is then taken up by hand at the body assembly 13, and the body assembly 13 is rotated clockwise, while the cable 11 is held stationary. The body assembly 13 could alternately be held stationary while the cable 11 is rotated, but generally, it is easier to rotate the body assembly 13 on the connector 10. By rotating the body assembly 13, the thread 55 bites into the shield 90 of the cable 11, engaging the shield 90. The body assembly 13 is rotated until the cable 11 is advanced fully to the rear face 50 of the cap 15. As the body assembly 13 is rotated over the cable 11, the shield progressively moves over each of the stops 56 formed in the thread 55.

When the cable 11 reaches close to the forward end of the cable-receiving interior 30, proximate to the rear face 50 of the cap 15, the thread 27 (seen most easily in FIG. 6A) engages with the jacket 91. The thread 27 bites into the jacket 91 as the cable 11 is rotated, so that the cable 11 becomes further secured on the connector 10. When the cable 11 reaches the rear face 50, the jacket 91 moves over the vertical stop at the end of the thread 27. The stop is a blunt end and is not ramped, so once the cable 11 has moved beyond the stop it cannot be moved back over it, and thus cannot be backed off of the thread 27 and out of the connector 10. Once fully applied, the cable 11 is secured on the threads 27 and 55 and on the inner post 21, and cannot be axially translated forwardly or rearwardly out of the connector 10. The blunt edges 57 of the plurality of stops 56 bite into, engage, and limit any rearward movement of the shield 90, and thus the cable 11, off of the thread 55. Further, the shield 90 and the jacket 91 are compressed between the outer surface 54 of the inner post 21 and the inner surface 26 of the body 14, and the dielectric 92 and the inner conductor are snugly fit into the bore 64 in the inner post 21, so that the cable 11 cannot be retracted from the connector 10.

In this arrangement, the shield 90 is in electrical communication with the outer surface 54 of the inner post 21, and the inner post 21 is in electrical communication with the nut 20, thereby maintaining continuity of electrical communication between the connector 10 and the cable 11. When the cable 11 is fully applied to the connector 10, the inner conductor 12 extends out through the mouth 84 of the nut 20, ready to be engaged to a female coaxial post of an electronic component. The connector 10 is thus fully applied and secured on the cable 10, ready for use. To apply the connector 10 to a female coaxial post, the connector 10 is merely taken up by hand at the nut 20, and the nut 20 is rotated onto the female coaxial post, so that the threads inside the nut 20 threadably engage onto the female coaxial post, thereby securing the connector 10 on the female coaxial post.

FIGS. 7-11B illustrate another embodiment of a coaxial cable connector 110 constructed and arranged in accordance with the principle of the invention, as it would appear in an applied condition on the coaxial cable 11. As before with the other embodiment, the connector 110 shown is an F connector for use with an RG6 coaxial cable for purposes of exemplification, but it should be understood that the description below is also applicable to other types of coaxial cable connectors other types of cables. The connector 110 includes a two-piece cylindrical body assembly 13' identical to the body assembly 13 of the connector 10, and, as such, the body assembly 13' and its constituent structural features and elements will be referred to with the same reference characters as those for the connector 10. The structural features and elements of the body assembly 13' will be marked with a prime symbol ("") to distinguish them from those of the connector 10. Indeed, throughout the remainder of this description, any structural features or elements whose corresponding reference characters include the prime symbol should be understood to be identical in structure to the structural feature or element carrying the same reference character without the prime designation. The body assembly 13' has both a body 14' and a cap 15'. The connector 110 also includes a coaxial nut 120 mounted for rotation to the cap 15' of the body assembly 13'. The nut 120 engages a female coaxial post of an electronic component in a different way than the fitting 20 of the connector 10, due to different structure than the fitting 20 of the connector 10, as will explained. Both the cap 15' and the nut 120 are carried on an inner post 21' shown in FIGS. 11A and 11B, which are section views taken along the line 11-11 in FIG. 7. The inner post 21' is also identical to that of the connector 10, and again, the inner post 21' and its constituent structural features and elements will be referred to with the same reference characters as those for the connector 10, though also marked with a prime symbol. A longitudinal axis A' extends through the center of the connector 110. The body assembly 13', the nut 120, and the inner post 21' each have rotational symmetry with respect to the longitudinal axis A', as shown in FIGS. 8A and 8B.

With reference to FIGS. 9, 10, 11A, and 11B, and as with the body 14, the body 14' of the body assembly 13' is an elongate sleeve extending along axis A'. It includes a sidewall 22', opposed front and rear ends 23' and 24', and opposed inner and outer surfaces 25' and 26'. The inner surface 25' defines and bounds a cable-receiving interior 30' shaped and sized to receive the coaxial cable 11. The inner surface 25' is formed with a three-quarters helical thread 27' proximate to the front end 23', which begins with a ramp 28 up from the smooth inner surface 25' and terminates approximately three-quarters circumferentially and helically around the inner surface 25' with a vertical stop. The cable-receiving interior 30' has a diameter B' defined by the inner surface 25'. Both the front and rear ends 23' and 24' are open, providing access to the cable-receiving interior 30'. The outer surface 26' of the sidewall 22' is formed with axially-oriented channels or grooves 29' to provide enhanced grip to the body 14'. The outer surface 26' defines an outer diameter C' of the body 14'.

Figure 9:
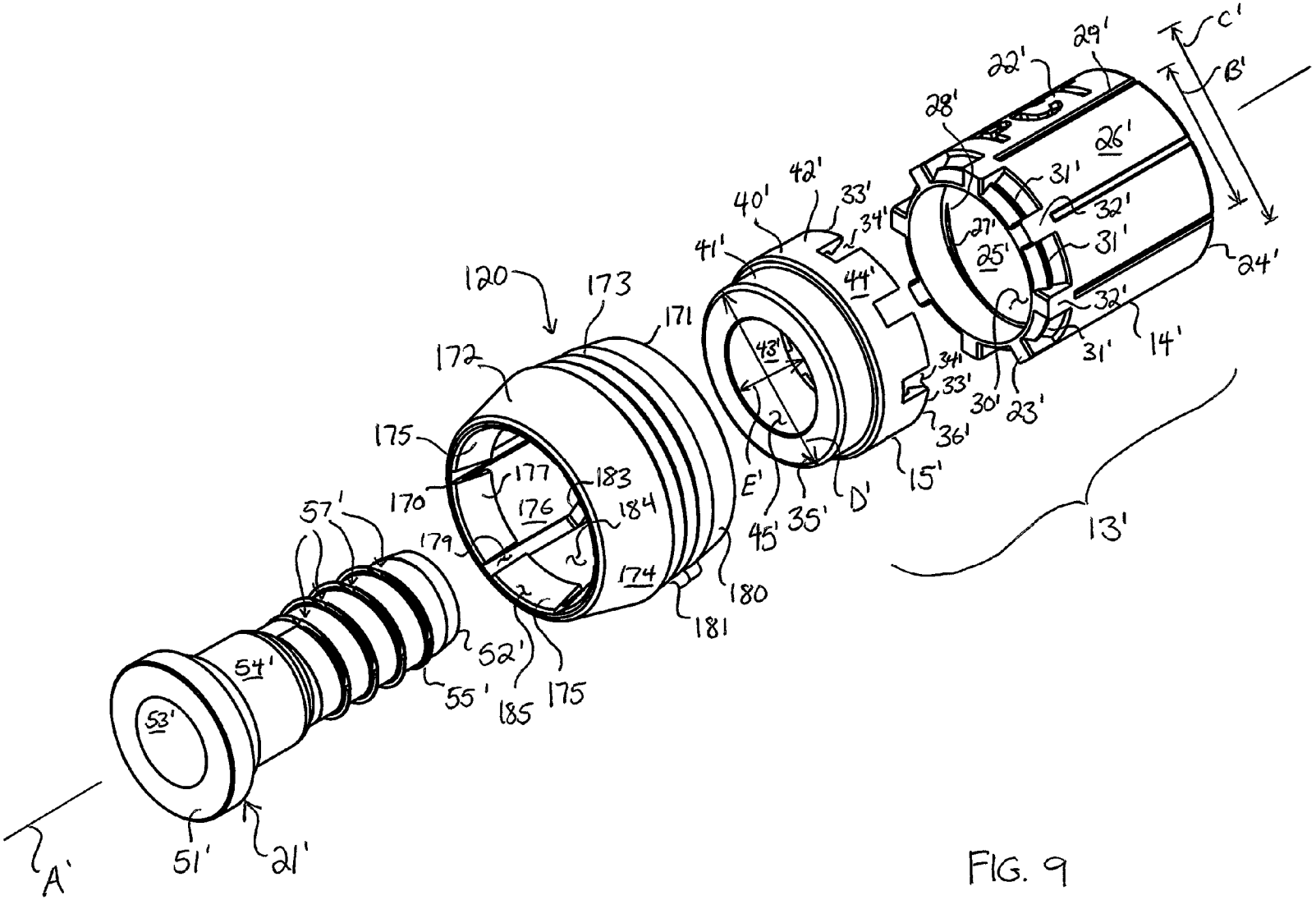
FIGS. 9 and 10 are top and bottom exploded perspective views, respectively, of the connector of FIG. 7.
Figure 10:
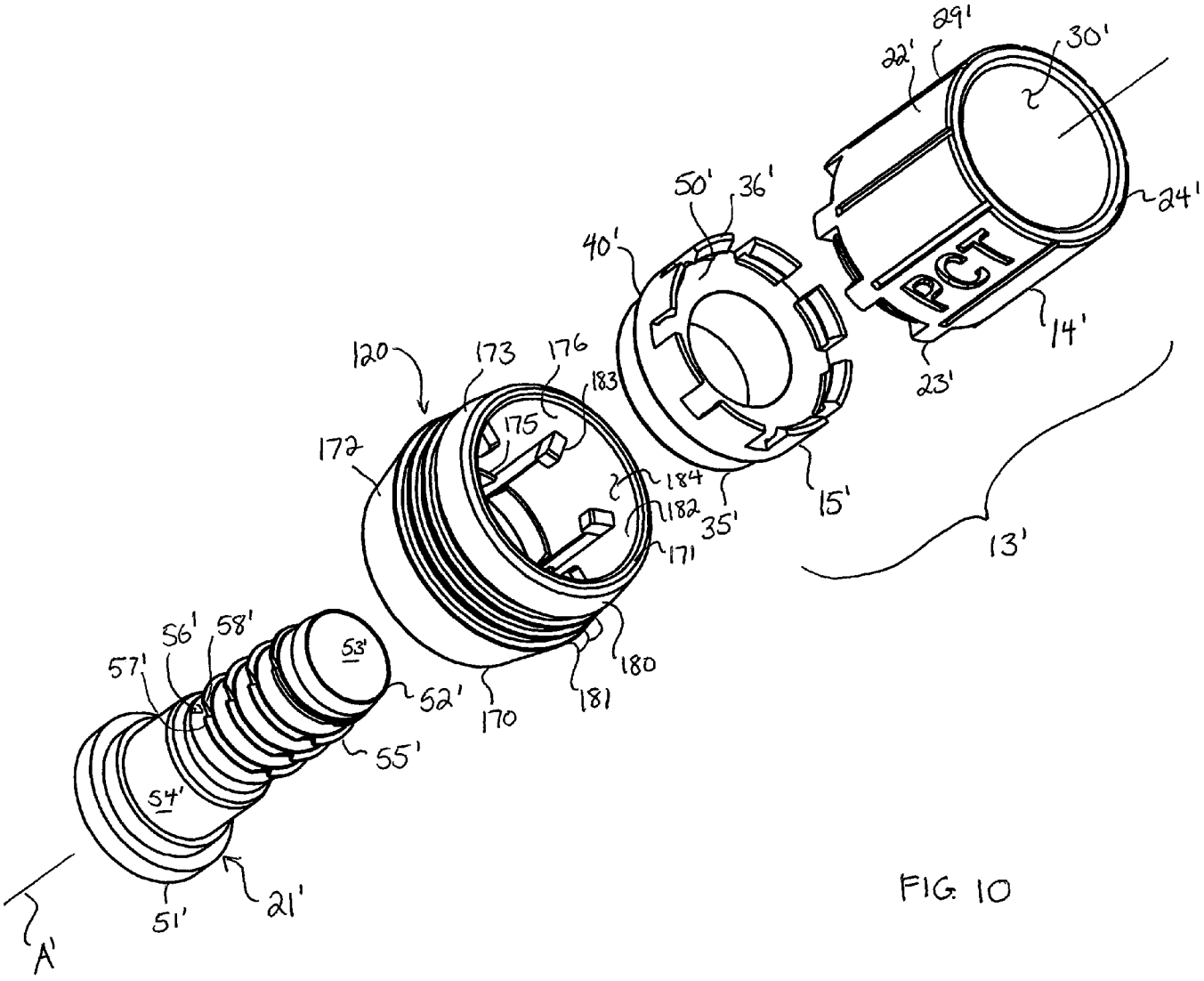

Referring now primarily to FIGS. 9 and 10, the front end 23' of the body 14' has an engagement structure for coupling with the cap 15'. Similar to the body 14 of the connector 10, the body 14' includes a plurality of semi-annular barbs 31' spaced apart from each other by blocks 32'. The complemental engagement structure on the cap 15' is a plurality of rearwardly-extending tabs 33' each with an enlarged head to fit over and engage with the barbs 31', and spaced apart by gaps 34' sized to receive the blocks 32'. The cap 15' has similar structure to that of the cap 15, namely, a front end 35', an opposed rear end 36', a stepped sidewall 40', a front portion 41', a rear portion 42', and a diameter D' of the rear portion 42'. The sidewall 40' has an inner surface 43', an opposed outer surface 44', a bore 45' with a diameter E, and an annular rear face 50'.

The inner post 21' is similar in structure to the inner post 21 of the connector 10. The inner post 21' is a hollow, elongate, cylindrical sleeve extending along the axis A' and having rotational symmetry with respect to that axis A'. The inner post 21' includes opposed front and rear ends 51' and 52', opposed inner and outer surface 53' and 54', and a helical thread 55' which winds about the outer surface 54' from the rear end 52' to a generally intermediate location between the front and rear ends 51' and 52'. The thread 55' is sharp, having a sharp crest between two oblique faces, and forms approximately four helical windings about the inner post 21'. By "helical," it is meant that the thread 55' advances both axially and circumferentially. The crest projects radially outwardly from the inner post 21'. The thread 55' includes a plurality of stops 56', each of which is a notch having a blunt edge 57' and a ramped edge 58', similar to the thread 55. The inner post 21' further includes three annular flanges 60', 61', and 62', most easily seen in FIG. 11A, and an annular channel 63'. The inner post 21' is constructed of a conductive material and maintains a continuous RF connection between the nut 120 and the coaxial cable 11'. The inner surface 53' of the inner post 21' bounds and defines a cylindrical bore 64' which is sized to tightly receive the coaxial cable 11'.

The nut 120 is mounted to the inner post 21' at the annular channel 63' formed between the fitting 21' and the cap 15'. The nut 120 is mounted for rotation about the axis A', so that the nut 120 can be rotated onto a female coaxial post of an electronic component. The nut 120 is a cylindrical sleeve having opposed front and rear ends 170 and 171, an integrally-formed collet portion 172 proximate to the front end 170, and an integrally-formed grip portion 173 proximate to the rear end 171. The collet portion 172 has a smooth conical outer surface 174 and a spaced-apart fingers 175 carried on an inner surface 176 for engagement with a female coaxial post. Each finger 175 includes a flap 177 depending toward the rear end 171 of the nut 120 from a living hinge 178 at the front end 170. The fingers 175 formed continuously around the inner surface 176 of the collet portion 172 of the nut 120, severed only by slim axial gaps 179 between the fingers 175.

The grip portion 173 of the fitting 170 has an annular outer surface 180 formed with several concentric, annular barbs 181 just behind the collet portion 172. The barbs 181 provide enhanced grip when the connector 110 is pushed onto a female coaxial post. An inner surface 182 of the grip portion 173 has several spaced-apart rectangular prismatic posts 183 extending radially inward toward the axis A'. The posts are rectangular prismatic extensions of the inner surface 182 extending into the interior of the nut 120. The posts 183 are seated into the annular channel 83' for rotatable movement of the nut 120 on the body assembly 13' when the nut 120 is assembled on the body assembly 13' of the connector 110. With the posts 183 seated in the channel 83', the nut 120 is prevented from both forward and rearward axial translation. The rear end 171 of the nut 120 is an annular cuff extending rearwardly past the posts 183, entirely overlying and concealing the front portion 41' of the cap 15'.

A cylindrical interior space 184 extends into the nut 120 from a mouth 185 formed at the front end 170 of the nut 120. When the nut 120 is mounted to the inner post 21', the front end 51' of the inner post 21' defines a stop in the interior space 184 beyond which the nut 120 cannot be applied onto a female coaxial post.

Figure 11A:
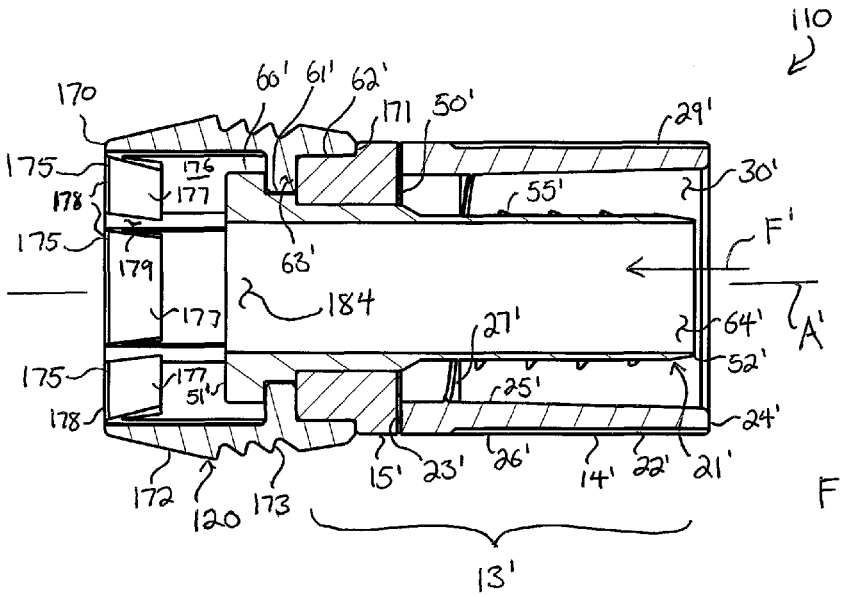
FIGS. 11A and 11B are section views taken along the line 11-11 in FIG. 1 illustrating the connector of FIG. 7 in a free condition and in an applied condition on a cable, respectively.
Figure 11B:
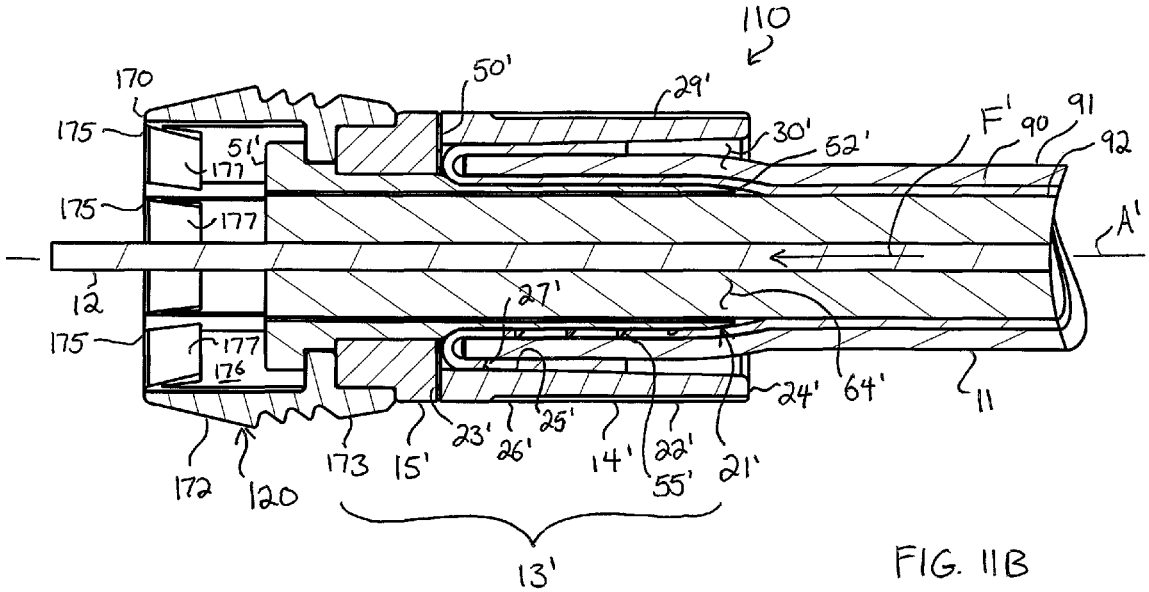

Referring now to FIGS. 11A and 11B, operation of the connector 110 will now be explained. The connector 110 is useful for applying to a coaxial cable without the use of tools, and has structural features and elements which allow the connector 110 to be so applied. Further, the connector 110 resists being accidentally removed from the cable. To apply the connector 110 onto the coaxial cable 11, the cable 11 is aligned with the axis A' and passed into the cable-receiving interior 30' of the body assembly 13' of the connector 110, at the rear end 24' of the body 14', by advancing the cable 11 along a direction indicated by the arrowed line F'. The coaxial cable 11 is passed into the cable-receiving interior 30' bound by the body 15' of the body assembly 13'. The cable 11 almost immediately encounters the rear end 52' of the inner post 21'. Upon encountering the rear end 52' of the inner post 21', the shield 90 and jacket 91 of the cable 11 are advanced over the rear end 52', while the inner conductor 12 and the dielectric insulator 92 are moved into the bore 64' within the inner surface 53' of the inner post 21'.

The connector 110 is then taken up by hand at the body assembly 13', and the body assembly 13' is rotated clockwise, while the cable 11 is held stationary. The body assembly 13' could be held stationary while the cable 11 is rotated, but generally, it is easier to rotate the body assembly 13' on the connector 110. By rotating the body assembly 13', the thread 55' bites into the shield 90 of the cable 11, engaging the shield 90. The body assembly 13' is rotated until the cable 11 is advanced fully to the rear face 50' of the cap 15'. As the body assembly 13' is rotated over the cable 11', the shield progressively moves over each of the stops 56' formed in the thread 55'.

When the cable 11 reaches close to the forward end of the cable-receiving interior 30', proximate to the rear face 50' on the cap 15', the thread 27' (seen more easily in FIG. 11A) engages with the jacket 91. The thread 27' bites into the jacket 91 as the cable 11 is rotated, so that the cable 11 becomes further secured on the jacket 91. When the cable 11 reaches the rear face 50', the jacket 91 moves over the vertical stop at the end of the thread 27'. The stop is a blunt end and is not ramped, so once the cable 11 has moved beyond the stop it cannot be moved back over it, and thus the cable 11 cannot be backed out of the connector 110. Once fully applied, the cable 11 is secured on the thread 55' and cannot be axially translated forwardly or rearwardly out of the connector 110. The blunt edges 57' of the plurality of stops 56' bite into, engage, and limit any rearward movement of the shield 90, and thus the cable 11, off of the thread 55'. Further, the shield 90 and the jacket 91 are compressed between the outer surface 54' of the inner post 21' and the inner surface 26' of the body 14', and the dielectric 92 and the inner conductor are snugly fit into the bore 64' in the inner post 21', so that the cable 11 cannot be retracted from the connector 110. In this arrangement, the shield 90 is in electrical communication with the outer surface 54' of the inner post 21', and the inner post 21' is in electrical communication with the nut 120, thereby maintaining continuity of electrical communication between the connector 110 and the cable 11.

When the cable 11 is fully applied to the connector 110, the inner conductor 12 extends out through the mouth 185 of the nut 120, ready to be engaged to a female coaxial post of an electronic component. The connector 110 is thus fully applied and secured on the cable 110, ready for use. To apply the connector 110 to a female coaxial post, the connector 10 is merely taken up by hand at the nut 120, and the fitting 20 is pushed onto the female coaxial post, so that the fingers 175 engage the female coaxial post. As the fitting 20 moves over the female coaxial post, which typically is ribbed or has a tight helical thread, the flaps 177 inside the collet portion 172 of the nut 120 are deflected and bent radially outward, compressed between the female coaxial post and the inner surface 176 of the collet portion 172. This binds the collet portion 172 onto the female coaxial post. The nut 120 resists rearward axial withdrawal from the female coaxial post, because rearward axial movement of the connector 10 urges the flaps 177, which are engaged with the ribs or threads on the female coaxial post, to move radially inward, against the female coaxial post. Without applying a destructive level of withdrawal force to the connector 110, the connector 110 cannot be removed from the female coaxial post.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

The invention claimed is:

1. A coaxial cable connector comprising:

a cylindrical body having a longitudinal axis, a front end, an opposed rear end, an interior, and an inner surface bounding the interior;

a cylindrical inner post extending through the cylindrical body, supporting the cylindrical body, and having an outer surface;

a coupling nut carried on the inner post at the front end of the cylindrical body;

a first thread formed on the inner surface of the body and having a ramped entrance directed toward the rear end of the body and a blunt end directed toward the front end of the body; and a second thread formed on the outer surface of the inner post and having a ramped entrance directed toward the rear end of the body, a blunt end directed toward the front end of the body, and a plurality of stops therebetween.

2. The coaxial cable connector of claim 1, wherein:

the first thread is directed radially outward; and the second thread is directed radially inward.

3. The coaxial cable connector of claim 1, wherein the first and second threads are axially spaced apart.

4. The coaxial cable connector of claim 1, wherein the first and second threads are radially spaced apart.

5. The coaxial cable connector of claim 1, wherein each stop formed in the second thread comprises a notch formed in the second thread, and includes a blunt edge and an opposed ramped edge.

6. The coaxial cable connector of claim 1, wherein the stops are aligned axially in sets.

7. The coaxial cable connector of claim 1, wherein the stops are aligned axially in quadrants around the inner post.

8. The coaxial cable connector of claim 1, further comprising:

a coupling nut carried on the inner post at the front end of the body; and the coupling nut includes a collet formed of a plurality of fingers extending rearwardly toward the front end of the body.

9. A coaxial cable connector comprising:

a cylindrical body having a longitudinal axis, a front end, an opposed rear end, an interior, and an inner surface bounding the interior;

a cylindrical inner post extending through the cylindrical body, supporting the cylindrical body, and having an outer surface;

a coupling nut carried on the inner post at the front end of the cylindrical body;

a first thread formed on the inner surface of the body and having a ramped entrance directed toward the rear end of the body and a blunt end directed toward the front end of the body; and a second thread formed on the outer surface of the inner post and having a ramped entrance directed toward the rear end of the body, a blunt end directed toward the front end of the body, and a plurality of stops therebetween;

wherein the first thread extends around an incomplete inner circumferential portion of the inner surface, and the second thread extends around the outer surface in multiple turns.

10. The coaxial cable connector of claim 9, wherein:

the first thread is directed radially outward; and the second thread is directed radially inward.

11. The coaxial cable connector of claim 9, wherein the first and second threads are axially spaced apart.

12. The coaxial cable connector of claim 9, wherein the first and second threads are radially spaced apart.

13. The coaxial cable connector of claim 9, wherein each stop formed in the second thread comprises a notch formed in the second thread, and includes a blunt edge and an opposed ramped edge.

14. The coaxial cable connector of claim 9, wherein the stops are aligned axially in sets.

15. The coaxial cable connector of claim 9, wherein the stops are aligned axially in quadrants around the inner post.

16. The coaxial cable connector of claim 9, further comprising:

a coupling nut carried on the inner post at the front end of the body; and the coupling nut includes a collet formed of a plurality of fingers extending rearwardly toward the front end of the body.

17. A coaxial cable connector comprising:

a cylindrical body having a longitudinal axis, a front end, an opposed rear end, an interior, and an inner surface bounding the interior;

a cylindrical inner post extending through the cylindrical body, supporting the cylindrical body, and having an outer surface;

a coupling nut carried on the inner post at the front end of the cylindrical body;

a first thread formed on the inner surface of the body and having a ramped entrance directed toward the rear end of the body and a blunt end directed toward the front end of the body; and a second thread formed on the outer surface of the inner post and having a ramped entrance directed toward the rear end of the body, a blunt end directed toward the front end of the body, and a plurality of stops therebetween, each stop comprising a notch in the second thread having a blunt edge and an opposed ramped edge;

wherein the first thread extends around an incomplete inner circumferential portion of the inner surface, and the second thread extends around the outer surface in multiple turns.

18. The coaxial cable connector of claim 17, wherein the first and second threads are both axially and radially spaced apart.

19. The coaxial cable connector of claim 17, wherein the stops are aligned axially in sets.

20. The coaxial cable connector of claim 17, wherein the stops are aligned axially in quadrants around the inner post.

* * * * *